United States Patent [19]

de Vries

[11] 4,056,928

[45] Nov. 8, 1977

[54] DETACHABLE LINK-CHAIN

[76] Inventor: Robert de Vries, 2 Valeriusstraat, The Hague, Netherlands

[21] Appl. No.: 681,508

[22] Filed: Apr. 29, 1976

[30] Foreign Application Priority Data

Sept. 15, 1975 Netherlands ..... 7510815

[51] Int. Cl.[2] ..... F16G 15/12

[52] U.S. Cl. ..... 59/83; 59/90

[58] Field of Search ..... 59/85, 78, 80, 82, 83, 59/84, 35, 90

[56] References Cited

U.S. PATENT DOCUMENTS

| | | | |
|---|---|---|---|
| 1,048,183 | 12/1912 | Lageson | 59/90 |
| 1,655,763 | 1/1928 | Fulford | 59/90 |
| 2,840,983 | 7/1958 | Keilbach | 59/83 |

*Primary Examiner*—Victor A. DiPalma
*Assistant Examiner*—Gene P. Crosby
*Attorney, Agent, or Firm*—Lester Horwitz

[57] ABSTRACT

An ever open link-chain, i.e. a link-chain having links which are readily to be mounted or dismounted manually without deformation but cannot get detached of themselves without manual intervention.

1 Claim, 5 Drawing Figures

DETACHABLE LINK-CHAIN

BACKGROUND OF THE INVENTION

This invention relates to a link-chain which is composed of with their loops interengaging links which are interlocking.

The thus far known links consist of closed circular or oval links which are so-called "closed forever", but this has the disadvantage that the assembling thereof is skilled labour which can only be done by the jeweller's smith.

SUMMARY OF THE INVENTION

The present invention has as its object to overcome the aforesaid disadvantage by providing a new type of link in the form of an 8 which is bent in the connecting portion between the loops so that the loops are situated in planes which are substantial parallel, and the smaller loop of one link going closely, with a tight sliding-fit, through the larger loop of another link when said loops are situated one over the other in one plane. In this manner the new link-chain is readily to be assembled by anyone, but it is not possible that the links get detached by themselves. If so desired the links are also readily to be detached again, however, by accurately aligning the respective loops again in the described manner. The links are thus "ever open".

The invention also comprises an apparatus in the form of a bending-box which is to be used for forming the new links, and consists of two hingedly connected parts, and in which, when the box is open, an 8-shaped link can be laid, which then, when the box is snapped to, is bent in the desired shape.

The invention is described in more detail in the following specification with reference to the drawing, in which the invention is illustrated.

DESCRIPTION OF THE PREFERRED EMBODIMENT

Figure 1:
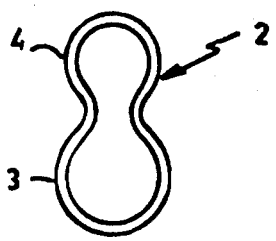
FIG. 1 shows the new link before it is bent in its final shape.
Figure 2:
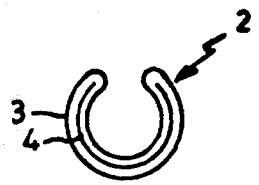
FIG. 2 shows the bent link in plan view.
Figure 3:
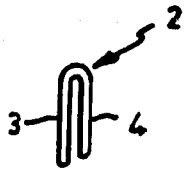
FIG. 3 is a side view thereof.

In the drawing is represented with 1 a link-chain which is assembled of links 2 in the form of an 8, of which in FIG. 1 the unbent original shape, and in FIGS. 2 and 3 the final bent shape is shown.

The larger loop 3 of a link fits closely, with a tight sliding-fit, over the smaller loop 4 of a subsequent link, when said loops are situated one over the other in one plane.

Figure 4:
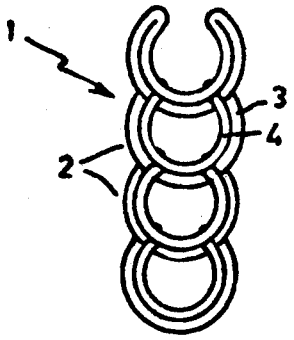
FIGS. 4 and 5 are a plan view and a side view, respectively, of a link-chain which is composed of such links.
Figure 5:
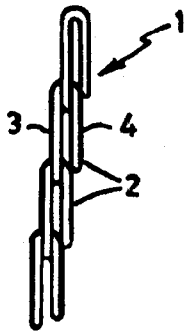

The so assembled link-chain is thus readily to be mounted and to be dismounted and is "ever open", but cannot get detached of itself. One link snaps resiliently over another when assembling and disassembling the link-chain which is shown in FIGS. 4 and 5.

Having thus described my invention, what I claim is:

1. A link-chain formed by assembling links in series, each of said links comprising a smaller and larger pair of connected substantially annular loops in substantially parallel superimposed relationship one to another, the outer diameter of said smaller loop being so dimensioned with respect to the inner diameter of said larger loop that the smaller loop of one link is insertable in a tight fit through the larger loop of the next adjacent link in said chain and wherein the distance apart of the two superimposed loops of each pair is sufficiently smaller than the diameter of the material of the rod forming said loop to permit the snapping of a subsequent link in or out.

* * * * *